US012590727B2

(12) United States Patent
Yoskowitz

(10) Patent No.: US 12,590,727 B2
(45) Date of Patent: Mar. 31, 2026

(54) STANDOFF FOR DUCTWORK DAMPER ASSEMBLY, DUCTWORK DAMPER ASSEMBLY INCORPORATING SAME AND METHOD OF ASSEMBLING DUCTWORK DAMPER ASSEMBLY

(71) Applicant: Capital Hardware Supply, LLC, Closter, NJ (US)

(72) Inventor: David Yoskowitz, Woodcliff Lake, NJ (US)

(73) Assignee: Capital Hardware Supply, LLC, Closter, NJ (US)

( * ) Notice: Subject to any disclaimer, the term of this patent is extended or adjusted under 35 U.S.C. 154(b) by 0 days.

(21) Appl. No.: 17/197,164

(22) Filed: Mar. 10, 2021

(65) Prior Publication Data

US 2021/0372656 A1 Dec. 2, 2021

Related U.S. Application Data

(60) Provisional application No. 62/972,371, filed on Feb. 10, 2020.

(51) Int. Cl.
*F24F 13/14* (2006.01)
*F24F 13/20* (2006.01)

(52) U.S. Cl.
CPC ..... *F24F 13/1426* (2013.01); *F24F 13/1486* (2013.01); *F24F 2013/202* (2013.01)

(58) Field of Classification Search
CPC ..... F24F 13/1426; F24F 13/1486; F24F 2013/202
USPC ..... 454/333
See application file for complete search history.

(56) References Cited

U.S. PATENT DOCUMENTS 185,404 A 12/1876 Poole
2,106,093 A * 1/1938 Goese ..... F24F 13/1486 251/308
2,114,115 A * 4/1938 Rosenberg ..... F23L 13/02 126/295
2,123,998 A * 7/1938 Koch ..... F24F 13/1426 126/295

(Continued)

FOREIGN PATENT DOCUMENTS

CA 2304996 C * 7/2003 ..... F23L 13/02
KR 100728701 B1 * 6/2007 ..... F24F 13/1426
WO 2018048832 A1 3/2018

OTHER PUBLICATIONS

KR-100728701-B1—Machine Translation (Year: 2022).*

(Continued)

*Primary Examiner* — Avinash A Savani
*Assistant Examiner* — Ryan L Faulkner
(74) *Attorney, Agent, or Firm* — Amster, Rothstein & Ebenstein LLP

(57) ABSTRACT

A standoff for a ductwork damper assembly includes a plate member and first and second leg members extending orthogonally from respective opposing sides of the plate member, the plate member having an aperture for receiving a pivot rod of a damper of the ductwork assembly, wherein the standoff is adapted for mounting on an outer surface of a section of ductwork of the ductwork damper assembly in the absence of fasteners at a site of contact between the first and second leg members and the surface of the section of ductwork.

15 Claims, 14 Drawing Sheets

(56) References Cited

U.S. PATENT DOCUMENTS

| | | | | | |
|---|---|---|---|---|---|
| 2,130,476 | A * | 9/1938 | Young | F23L 13/00 | 116/277 |
| 2,183,292 | A * | 12/1939 | Kerentoff | F23L 13/02 | 16/229 |
| 2,230,882 | A * | 2/1941 | Cameron | F23L 13/00 | 126/295 |
| 2,345,997 | A * | 4/1944 | Anderson | B63J 2/02 | 126/285 R |
| 3,668,999 | A * | 6/1972 | Alley | F24F 13/1426 | 454/194 |
| 4,193,541 | A * | 3/1980 | Scheidweiler | F23L 13/02 | 126/285 B |
| 4,646,715 | A * | 3/1987 | Russell | F23L 13/02 | 411/389 |
| D300,778 | S * | 4/1989 | Giannone | D8/308 | |
| 5,582,544 | A | 12/1996 | Ely | | |
| 5,901,502 | A | 5/1999 | Rafalski et al. | | |
| 6,035,849 | A * | 3/2000 | Bluestone | F23L 13/02 | 126/285 R |
| D478,202 | S * | 8/2003 | Snyder | D23/386 | |
| 7,188,481 | B2 * | 3/2007 | DeYoe | F24F 13/1426 | 62/186 |
| 7,472,699 | B2 * | 1/2009 | Martin | F16K 35/025 | 251/98 |
| 11,561,024 | B2 * | 1/2023 | Cunha | F24F 13/1426 | |
| 2009/0093209 | A1 * | 4/2009 | Bernal | F24F 13/1426 | 454/333 |
| 2009/0095106 | A1 * | 4/2009 | Hollender | F24F 13/1426 | 700/282 |
| 2009/0111373 | A1 * | 4/2009 | Hollender | F24F 11/56 | 454/333 |
| 2015/0147955 | A1 * | 5/2015 | Yoskowitz | F16K 1/221 | 454/333 |
| 2018/0066866 | A1 * | 3/2018 | Amirian | F24F 13/10 | |

OTHER PUBLICATIONS

Definition of fastener—Wikipedia.*

Cunha, Joao Maria Ruela, 62384507,Specification,2016-09-07.pdf, "Handle assembly for rotating pivot rod attached to a damper within a ductowork", Sep. 2016, pp. 1-8.*

* cited by examiner

STANDOFF FOR DUCTWORK DAMPER ASSEMBLY, DUCTWORK DAMPER ASSEMBLY INCORPORATING SAME AND METHOD OF ASSEMBLING DUCTWORK DAMPER ASSEMBLY

FIELD OF THE INVENTION

The present invention relates to improved standoffs for ductwork damper assemblies of heating and cooling ductwork systems. The invention also relates to improved ductwork and ductwork damper assemblies which incorporate such standoffs.

BACKGROUND OF THE INVENTION

It is well known in ducted heating, ventilating or air conditioning systems to provide, at selected locations, regulating damper assemblies for controlling the rate of flow of air or the like through the ducts of the HVAC system. Such known ductwork damper assemblies generally include a damper blade made of sheet metal and dimensioned to conform substantially to the cross-section of the air duct intended for passage of air or the like in a regulated manner. In general, the damper blade has a circular shape and is fitted in a circular air duct of slightly larger diameter to permit pivotal rotation of the damper blade.

The damper blade is rotatably attached to a shaft (i.e., pivot rod) which is itself rotatably connected to the duct by bearing-type bushings, such that the damper blade is pivotable within the duct as the shaft is rotated. One end of the pivot rod extends outwardly from the duct and is pivotally rotatable through an actuator, for example a lever, to one of a number of selected angular orientations to control the airflow through the duct. The ductwork oftentimes also includes a standoff for mounting the lever at an increased distance from the ductwork section which facilitates access to the lever when the ductwork is surrounded by insulating material.

Conventional standoffs are connected to the outer surface of the ductwork at the site of contact between the standoff and the ductwork by fastening means, for example by rivets or spot welds.

It is an object of the present invention to provide an improved damper unit that offers a more economical and cost-effective securement of the standoff on the ductwork.

SUMMARY OF THE INVENTION

According to one aspect of the invention, a standoff for a ductwork damper assembly, includes a plate member and first and second leg members extending orthogonally from respective opposing sides of the plate member, wherein the plate member has a substantially central aperture for receiving a pivot rod of a damper received in a section of ductwork of the ductwork damper assembly, wherein the standoff is adapted for mounting on an outer surface of a section of ductwork of the ductwork damper assembly in the absence of fasteners at a site of contact between the first and second leg members and the surface of the section of ductwork.

According to another aspect of the invention, a ductwork damper assembly comprises

- a section of ductwork;
- a damper plate attached to a pivot rod, said damper plate pivotably mounted in the section of ductwork via the pivot rod, with an end of the pivot rod radially extending from the section of ductwork;

- a standoff comprising a plate member and first and second leg members extending orthogonally from respective opposing sides of the plate member, said plate member having a substantially central aperture, said first and second leg members of the standoff in contact with an outer surface of the ductwork section, said pivot rod extending through the substantially central aperture of the plate member;
- a handle mounted on the end of the pivot rod in rotative fixed relation with the pivot rod; and
- a member threadably engaged on threads provided on the end of the pivot rod so as to bias the standoff against the outer surface of the ductwork section, the standoff being held on the ductwork section in the absence of any fastening means at a site of contact between the standoff and the outer surface of the ductwork section.

According to another aspect of the invention, a method of assembling a ductwork damper assembly includes the steps of

- providing a standoff assembly, said standoff assembly comprising a standoff which comprises
  - a plate member and first and second leg members extending orthogonally from respective opposing sides of the plate member, said plate member having a substantially central aperture,
  - a first threaded member received in the substantially central aperture of the standoff, said threaded member having a central through opening and an external threading, and
  - a second threaded member having an internal threading and threadably received on the external threading of the first threaded member;
- mounting the standoff assembly on a pivot rod of a damper plate arranged in a section of ductwork so that the pivot rod is received in the through opening of the first threaded member; and
- engaging a third threaded member on a threaded end of the pivot rod.

According to a further aspect of the invention, a standoff assembly for a ductwork damper assembly, comprises

- a standoff which comprises a plate member and first and second leg members extending orthogonally from respective opposing sides of the plate member, said plate member having a substantially central aperture,
- a first threaded member received in the substantially central aperture of the standoff, said threaded member having a central through opening and an external threading, and
- a second threaded member having an internal threading and threadably received on the external threading of the first threaded member.

According to another aspect of the present invention, the end of the pivot rod has a shape that prevents disengagement of the third threaded member form the end of the pivot rod after the third threaded member is engaged thereon.

BRIEF DESCRIPTION OF THE DRAWINGS

The above and other advantages of the invention will be further described and appreciated by those skilled in the art by reference to the following detailed description of the invention, the claims and the appended drawings in which:

DETAILED DESCRIPTION OF PREFERRED EMBODIMENTS

Figure 1:
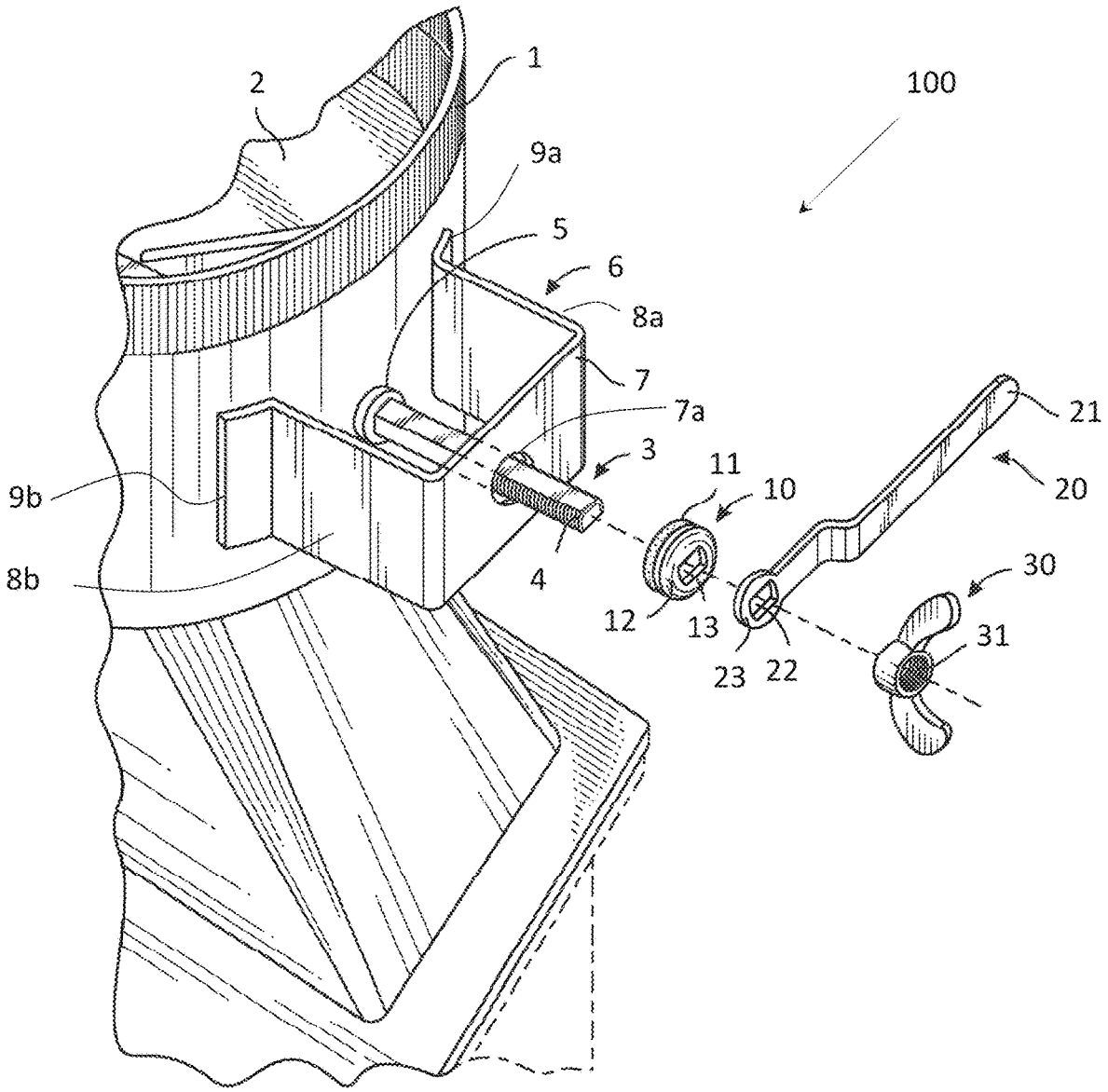
FIG. 1 is an exploded perspective view of a damper unit for ductwork according to the present invention.

Referring to FIGS. 1 through 9 and, in particular, FIG. 1, there is shown an exploded view of an embodiment of a damper assembly 100 according to the present invention. A damper plate 2 is rotatably attached to a pivot rod 3, which is itself rotatably mounted in the section of ductwork 1 by bearing type bushings 5, such that the damper blade 2 is pivotable within the section of ductwork 1 as the pivot rod 3 is rotated. One end 4 of the pivot rod 3 extends outwardly from the section of ductwork 1. A standoff 6 in the form of a U-shaped bracket is positioned on the outer surface of the section of ductwork 1 so that the pivot rod 3 extends through a substantially central opening 7*a* of the standoff 6.

The embodiment shown in FIG. 1 also includes a washer 10, and a lever 20 each having respective openings 13, 22 that conform to the cross-sectional shape of the pivot rod 3 for reception of the washer and lever on the pivot rod 3. Further provided is a wingnut 30 for threaded engagement on the threaded end 4 of the pivot rod 3. The washer may be a metal ring or include a circular rubber pad 11 joined to a circular metal plate along adjacent surfaces.

Figure 2:
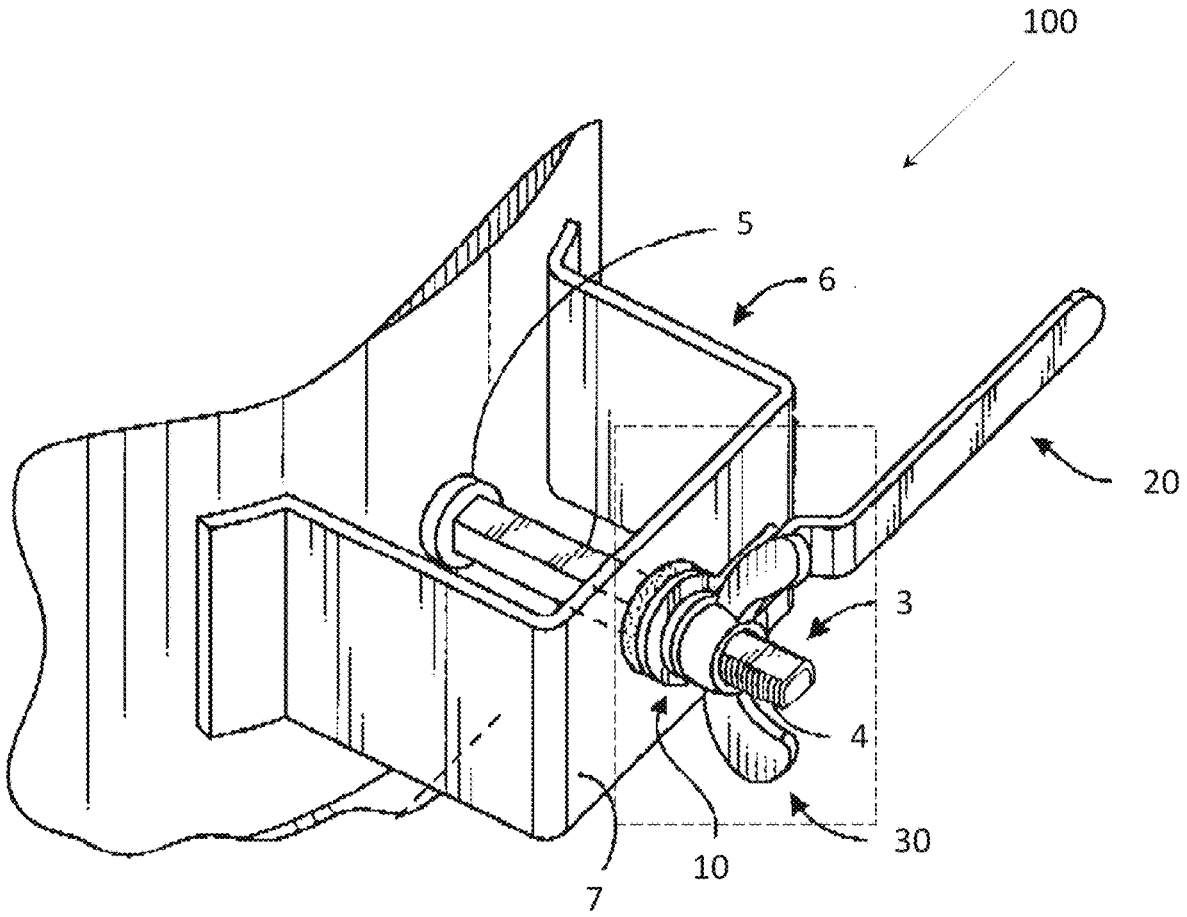
FIG. 2 is a perspective view of the assembly of FIG. 1, after the washer and handle have been received on the pivot rod and the wingnut has been threadably engaged to the threaded end of the pivot rod.

FIG. 2 shows the damper assembly 100 of FIG. 1 with the washer 10, lever 20 and wingnut 30 received on the end 4 of the pivot rod 3. The wingnut 30 is tightened so as to urge the lever 20 and washer 10 against the standoff 6 thereby biasing the standoff 6 against the outer surface of the section of ductwork 1. The lever 20 is received on the pivot rod 3 in rotative fixed relation with the pivot rod 3 so that pivoting of the lever 20 causes rotation of the pivot rod 3 and as a result pivoting of the damper plate in the section of ductwork 1.

The standoff 6 is held on the section of ductwork 1 in the absence of any fastening means at the sites of contact between the standoff 6 and the surface of the section of ductwork 1. In particular, the standoff 6 is held on the surface of the section of ductwork 1 without the provision of any positive connection or material connection between the standoff 6 and the surface of the section of ductwork 1.

Figure 3:
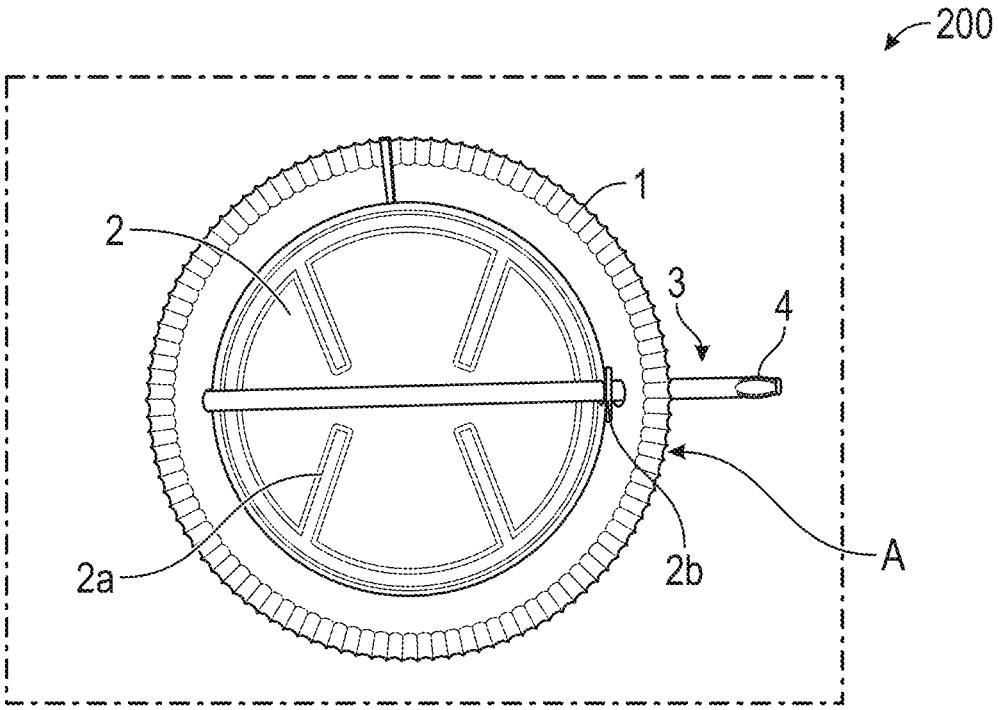
FIG. 3 is an internal view of an embodiment of a ductwork section with damper plate.
Figure 4:
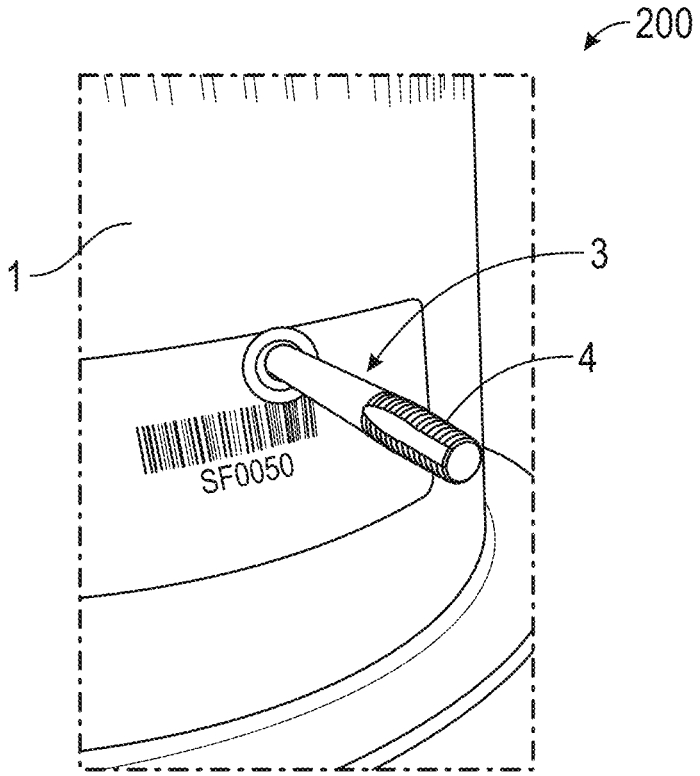
FIG. 4. Shows the embodiment of FIG. 3 in a view taken along the direction indicated by the arrow A.

In the embodiment of the damper assembly shown in FIGS. 1 and 2, the pivot rod 3 has a substantially square cross section. Embodiments with other cross-sectional shapes of the pivot rod are also within the scope of the invention. FIGS. 3-6 illustrate an embodiment of a damper assembly 200 according to the invention in which the pivot rod 3 has a c-shaped cross section. Referring to FIG. 3, the damper plate 2 in this embodiment is a stamped sheet metal part with integral pivot rod 3. The damper plate 2 and the pivot rod are made from the same sheet metal blank during a stamping process. During the stamping process, the damper plate 2 is also provided with indentations 2*a* (only one of the indentations is indicated by reference numeral) for increased rigidity of the damper plate 2. FIG. 4 shows the c-shaped cross section of the pivot rod 3.

Figure 5:
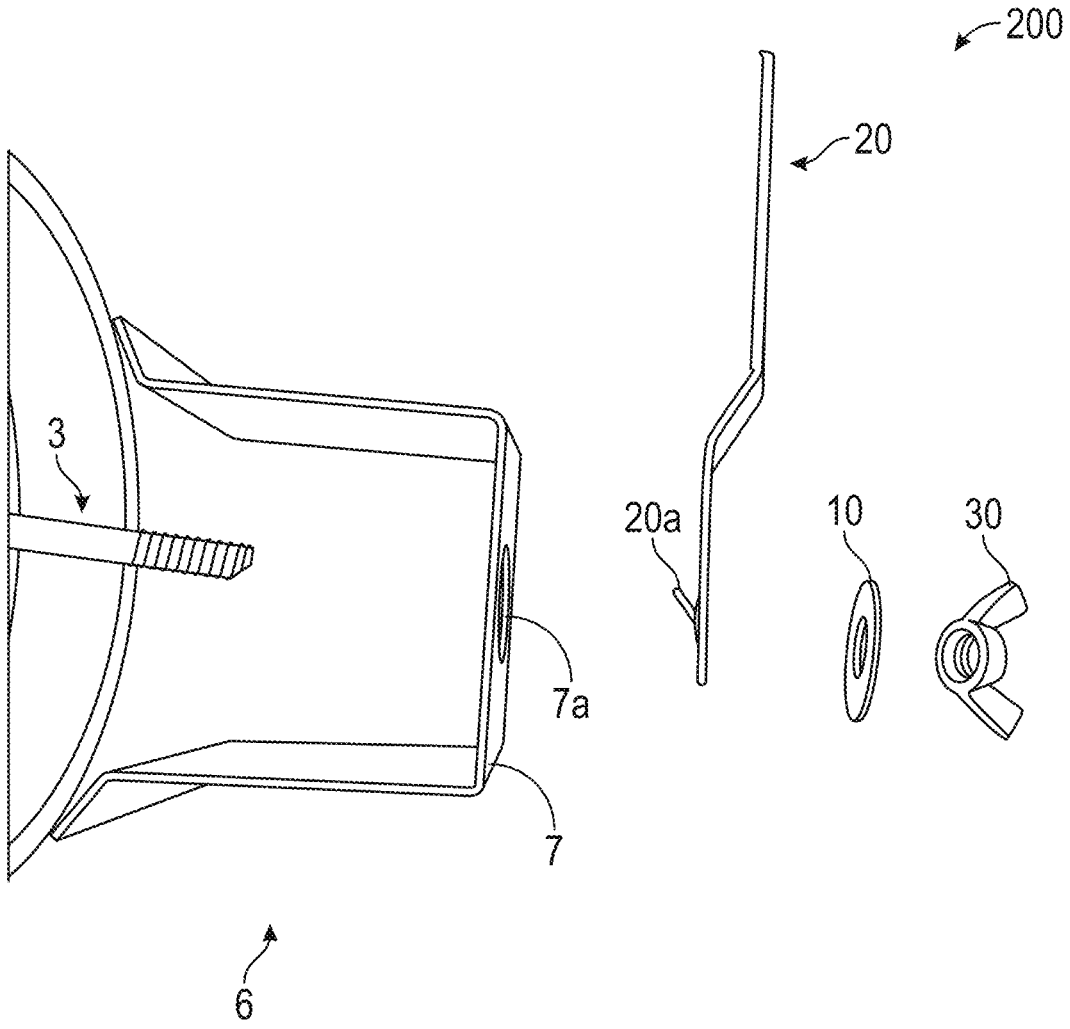
FIG. 5 shows an exploded view of an embodiment of the damper unit according to the invention with the ductwork section and damper of FIG. 3.
Figure 6:
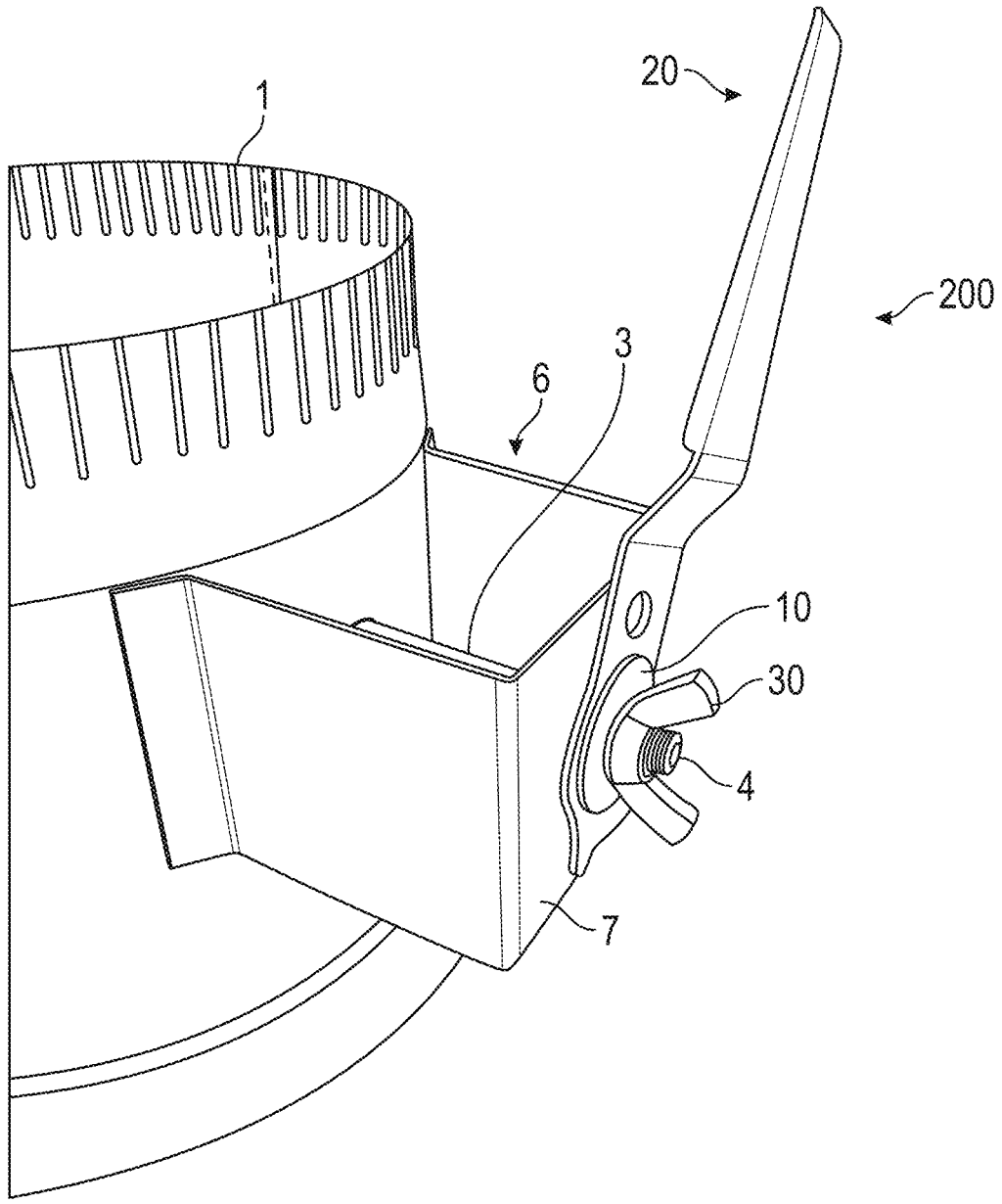
FIG. 6 shows the embodiment of FIG. 5 in the assembled state.

Referring now to FIGS. 5 and 6, FIG. 5 shows an exploded view of the embodiment of the damper 200 assembly in which the pivot rod 3 has a c-shape cross section. This embodiment also includes a standoff 6 with a central aperture 7*a*, a lever 20, a washer 10 and a wingnut (i.e., threaded fastener) 30. FIG. 6 shows the components of the damper assembly of FIG. 5 in the assembled state.

Figure 7:
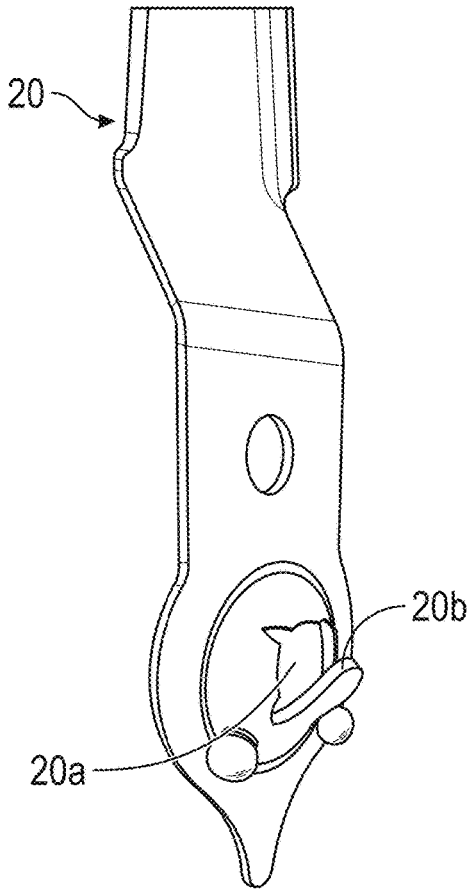
FIG. 7 shows an enlarged front side perspective view of the lever of the embodiment of FIG. 6.
Figure 8:
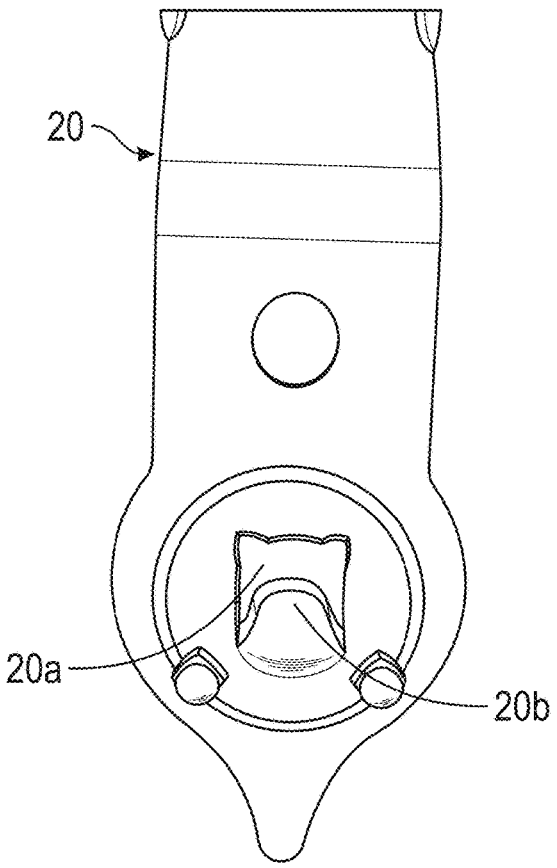
FIG. 8 shows an enlarged front perspective view of the lever of the embodiment of FIG. 6.
Figure 9:
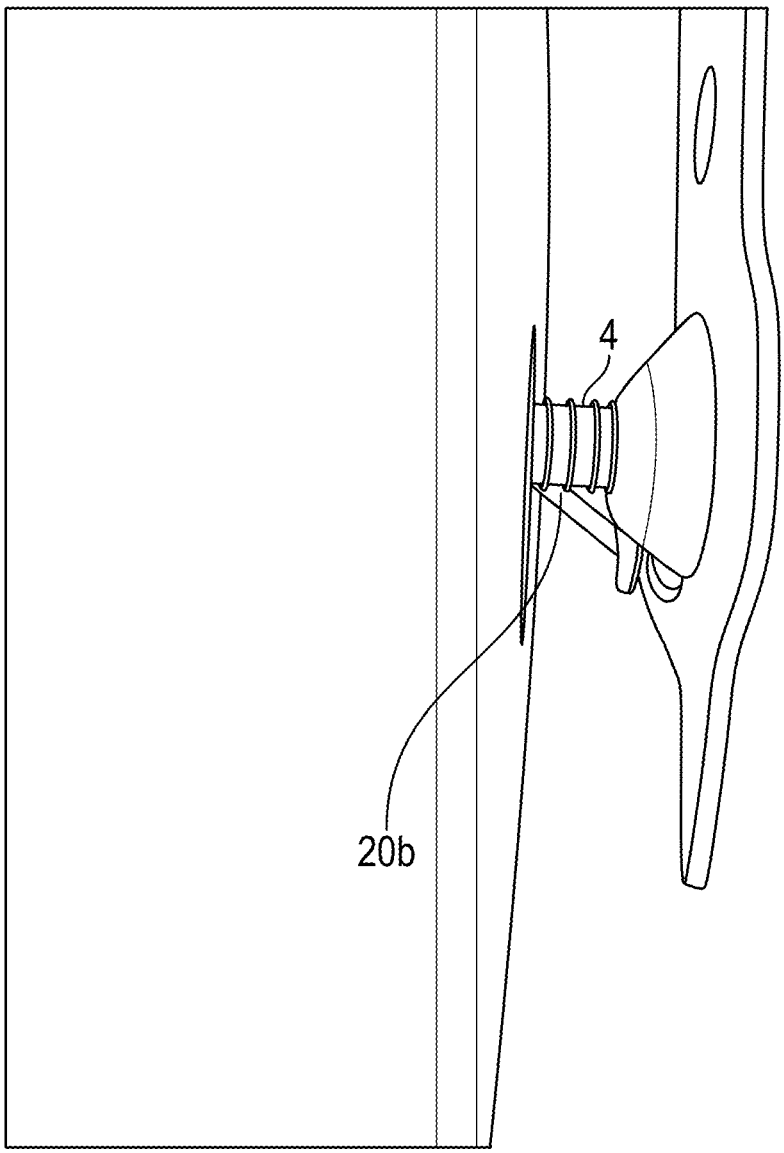
FIG. 9 is a detail side perspective view of the embodiment shown in FIG. 6, illustrating engagement of the lever on the threaded end of the pivot rod.

FIGS. 7 and 8 show a detailed view of the lever of the embodiment of the damper assembly shown in FIG. 6. The lever 20 has an opening 20*a* for receiving the pivot rod 3. The lever 20 further has a tongue 20*b* that engages in the concave side of the c-shaped pivot rod 3, as shown in FIG. 9, so as to enable rotation of the pivot rod 3 via rotation of the lever 20.

Referring again to FIG. 3, the damper assembly may further include a washer 2*b* provided on a portion of the pivot rod 3 that extends inside the section of ductwork 1. The washer 2*b* acts as a spacer between the circumference of the damper plate 2 and the inner surface of the section of ductwork 1 and thus prevents contact between the circumference of the damper plate and the inner surface of the section of the ductwork 1. This advantageously reduces the frictional forces between the damper plate 2 and the inner surface of the section of ductwork 1 when the wingnut 30 is tightened and causes the damper plate to be biased against the inner surface of the section of ductwork 1.

Figure 10:
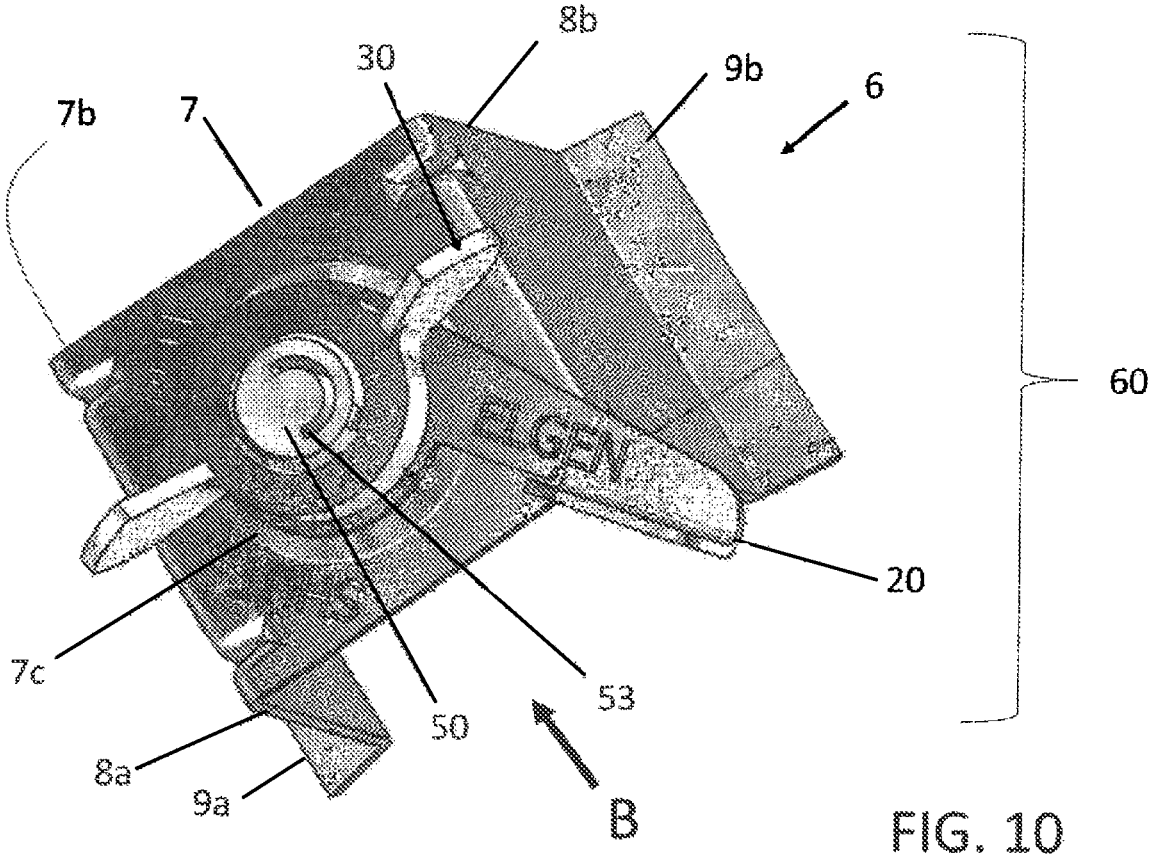
FIG. 10 is a front side perspective view of a standoff assembly according to an embodiment of the invention.
Figure 11:
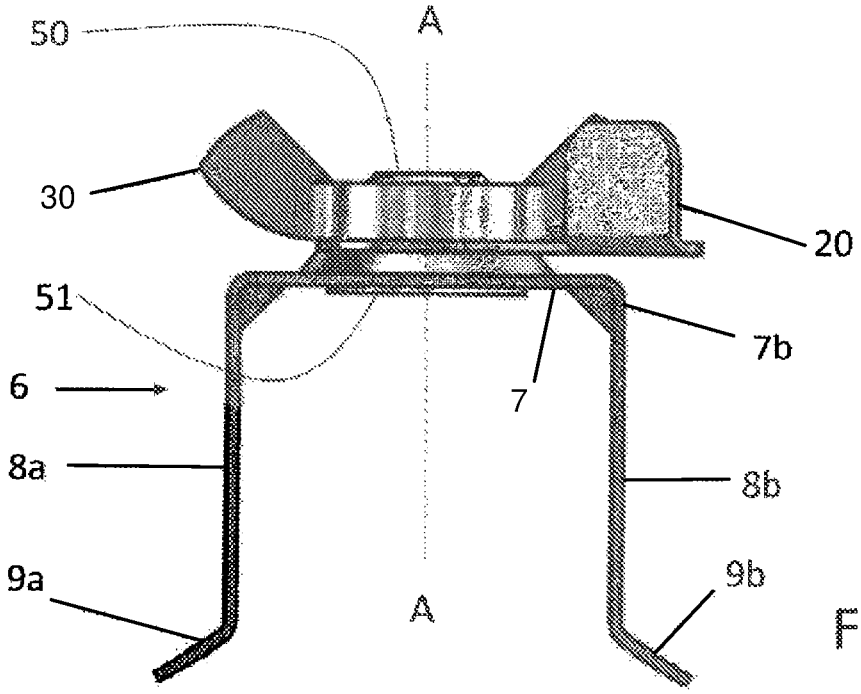
FIG. 11 is a bottom perspective vow of the standoff assembly shown in FIG. 10 taken in the direction indicated by arrow B.

Referring now to FIGS. 10 through 19 and, in particular, FIG. 10, there is shown a front side perspective view of another embodiment of a handle assembly 60 in accordance with the present invention. The handle assembly 60 includes standoff 6, threaded member 50 (e.g., a first threaded member 50), lever 20 and wingnut 30.

Figure 12:
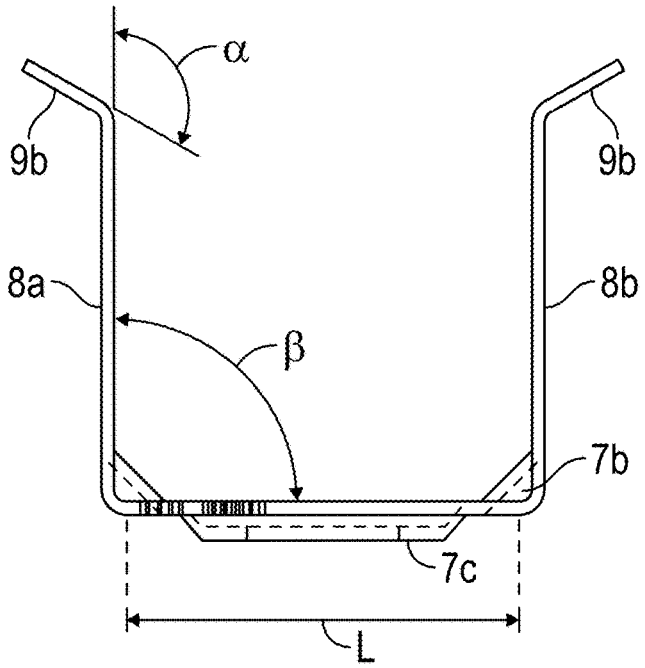
FIG. 12 is a top, plan view of the standoff shown in FIG. 10.
Figure 13:
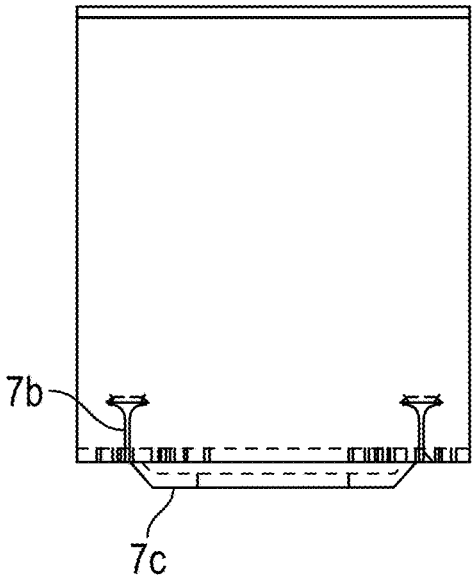
FIG. 13 is a side, plan view of the standoff shown in FIG. 10.
Figure 14:
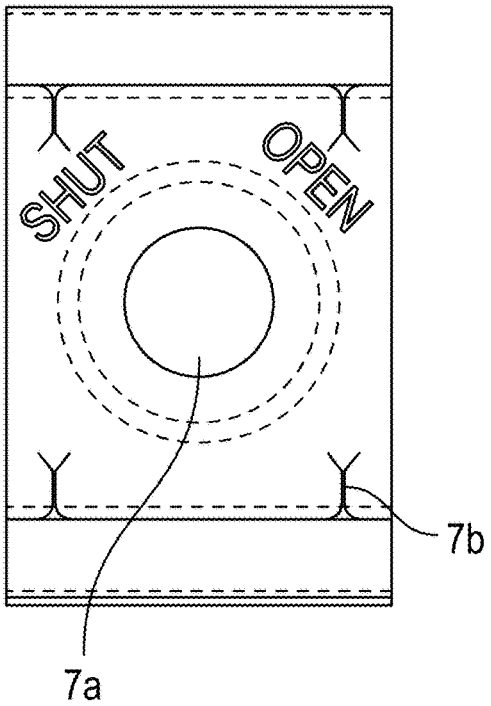
FIG. 14 is a front, plan view of the standoff shown in FIG. 10.

Referring to FIGS. 10-14, the standoff 6 of the handle assembly 60 includes a central plate member 7 and first and second leg members 8*a*, 8*b* that terminate in respective bent feet 9*a*, 9*b*. The standoff further has gussets 7*b* formed in the edges along which the plate member 7 is connected with the leg members 8*a*, 8*b*. The gussets 7*b* increase resistance against bending of the legs 8*a*, 8*b* away from each other. As shown in FIG. 12, the standoff 6 further includes a raised circular central portion 7*c*, which increases rigidity of the plate member 7. The angle β formed between the legs 8*a*, 8*b* and the plate member 7 is preferably 90°. The angle α of the feet 9*a*, 9*b* with respect to the legs 8*a*, 8*b* may vary and can be selected depending on the diameter of the section of ductwork. In a currently preferred embodiment, the angle α is 120°. Embodiments of the standoff 6 in which the leg members 8*a*, 8*b* are configured straight, i.e., without bent feet, are also within the scope of the present invention.

Figure 15:
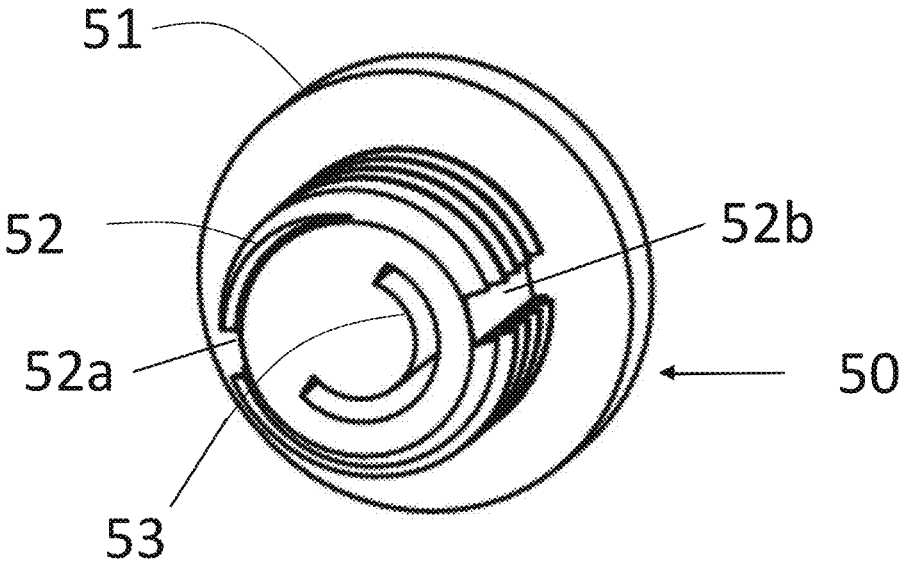
FIG. 15 is a front side perspective view of the threaded member shown in FIG. 10.
Figure 16:
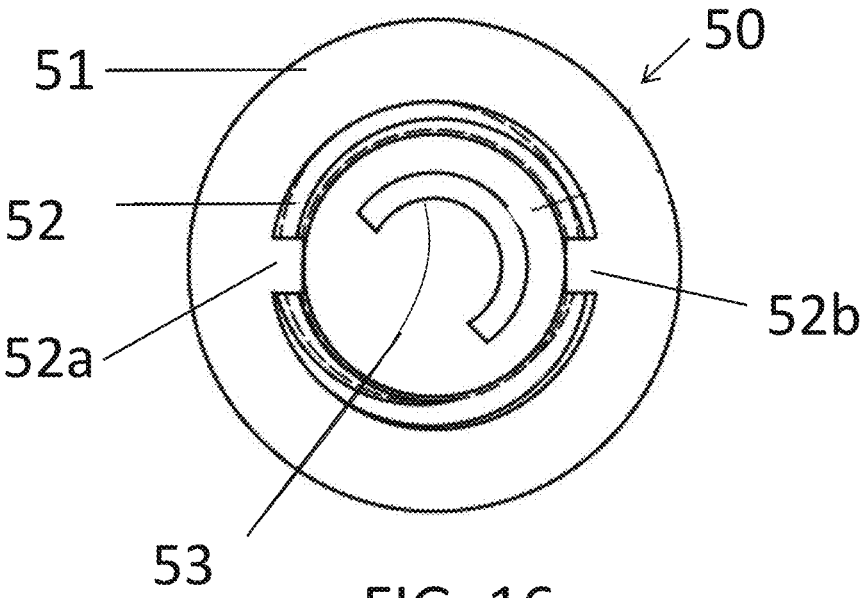
FIG. 16 is a front plan view of the threaded member of FIG. 15.

FIGS. 15-16, show the threaded member 50 of the handle assembly 60. FIG. 15 shows a front side perspective view and FIG. 16*a* front plan view of the threaded member 50. The first threaded member 50 has a threaded portion 52 and a flange 51. The threaded portion 52 is provided with a C-shaped through-opening 53 and diametrically opposed grooves 52*a*, 52*b* that extend axially along the threaded portion 52.

Figure 17:
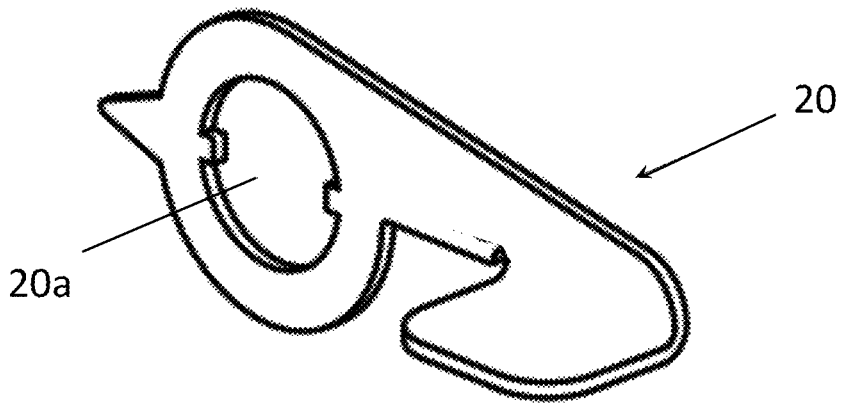
FIG. 17 is a front side perspective view of the handle shown in FIG. 10.
Figure 18:
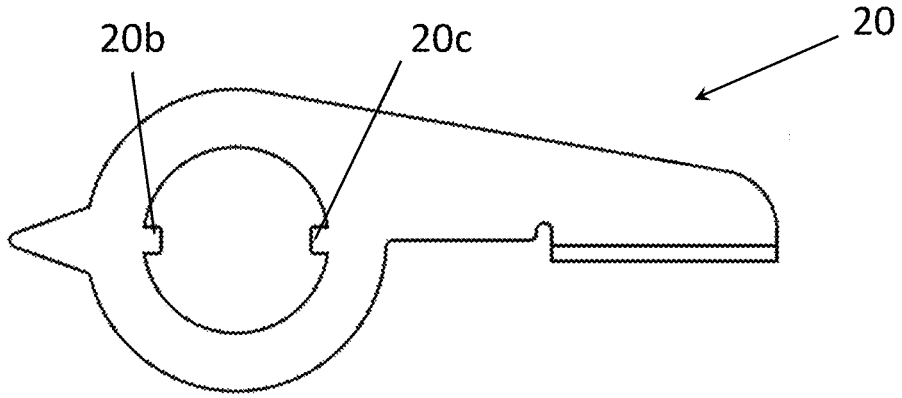
FIG. 18 is a front plan view of the handle shown in FIG. 17.

FIGS. 17 and 18 show the lever 20 of the handle assembly 60. FIG. 17 shows a front side perspective view and FIG. 18 a front plan view of the lever 20. The lever 20 has a through-opening 20*a* for receiving the threaded portion 52 of the threaded member 50. In the through-opening 20*a*, notches 20*b*, 20*c* are formed for engagement in the grooves 52*a*, 52*b* of the threaded portion 52 in a male-to-female interface arrangement as illustrated in FIGS. 15-18.

Referring again to FIGS. 10-11, the handle assembly 60 is shown in the assembled state. In the assembled state of the handle assembly 60, the threaded portion 52 of the first threaded member 50 is received in the central aperture 7*a* of the standoff 6 and the lever 20 is received on the threaded portion 52 so that the notches 20*b*, 20*c* engage in the grooves 52*a*, 52*b* of the threaded portion 52. The flange 51 of the first threaded member 50 is received in the circular raised portion 7*c* of the standoff 6. Engagement of a second threaded member 30 (e.g., the wingnut 30 of FIG. 10 or a hex nut 30 of FIG. 19) on the threaded portion 52 of the first threaded member secures the lever 20 on the threaded portion 52. The first threaded member 50 can be rotated about axis A-A by pivoting of lever 20.

Figure 19:
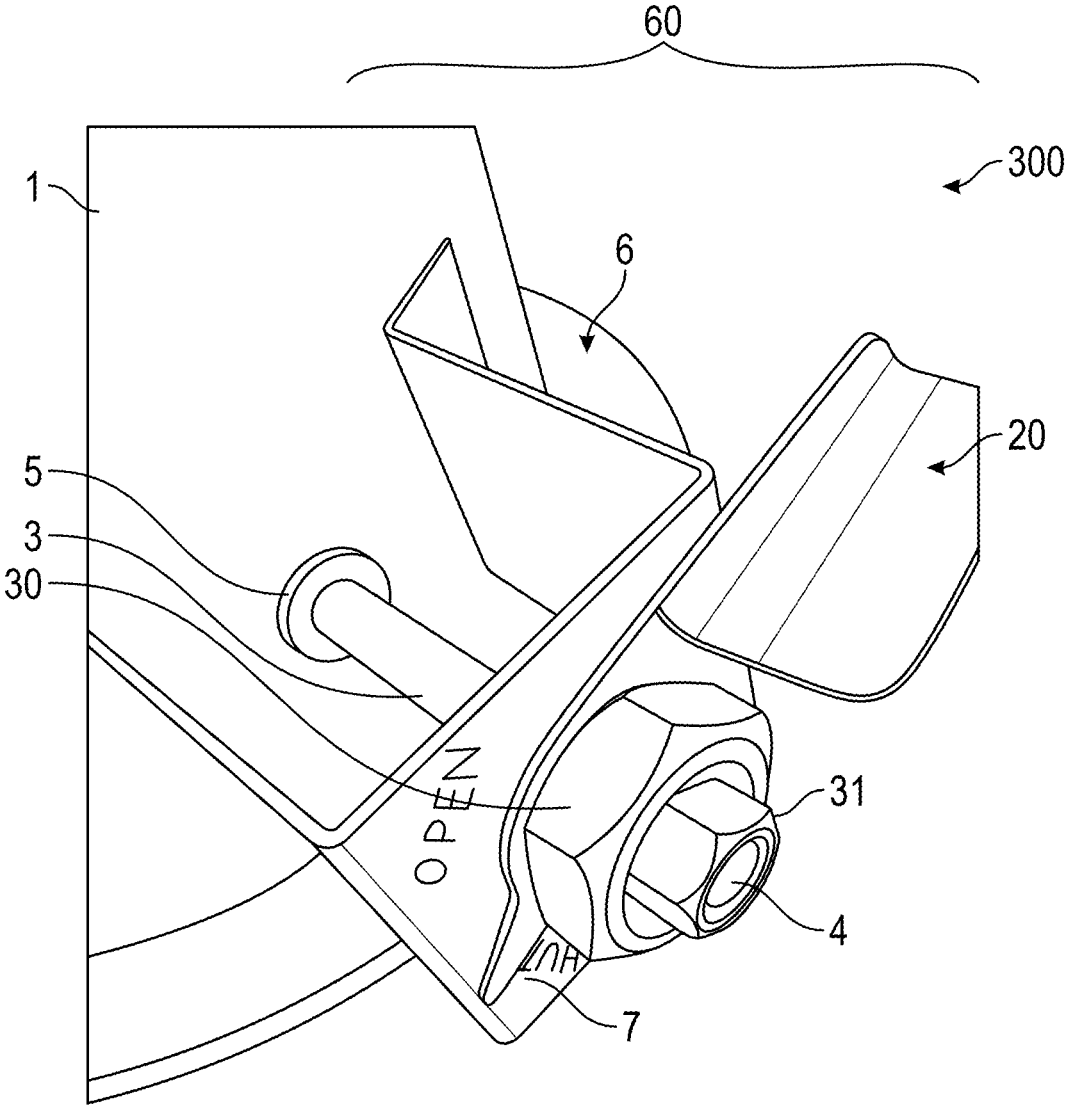
FIG. 19 Is a front side perspective view of another embodiment of a damper assembly in accordance with the invention.

FIG. 19 shows an embodiment of a damper assembly 300 which includes the handle assembly 60. The handle assembly is mounted on the section of ductwork 1 so that the pivot rod 3 of the damper plate of the section of ductwork 1 is received in the through-opening 53. A further (third) threaded member, for example a hex nut 31 or further wingnut, is then engaged on the threaded end of the pivot rod 3 and tightened, whereby the handle assembly 60, and with this the standoff 6, is biased against the outer surface of the section of ductwork 1. As in the damper assembly 100 shown in FIG. 1, the standoff 6 of the handle assembly 60 is held on the section of ductwork 1 in the absence of any fastening means at the sites of contact between the standoff 6 and the surface of the section of ductwork. In particular, the standoff 6 of the handle assembly 60 is held on the surface of the section of ductwork without the provision of any positive connection or material connection at the sites of contact, between the standoff 6 and the surface of the section of ductwork 1, in particular, between the legs and feet of the standoff and the surface of the section of ductwork 1.

In another embodiment, the handle assembly 60 can further include the threaded member 31. This has the advantage that the threaded member 31 does not have to be separately located and can be readily engaged on the pivot rod 3 after mounting of the handle assembly 60 on the section of ductwork 1.

The threaded member 50 of the handle assembly 60 has a c-shaped through opening for reception of a correspondingly c-shaped pivot rod. The pivot rod and the through opening of the threaded member 50 can have any cross-sectional shape, so long as engagement of the pivot rod in the through opening results in rotative fixed relation between the pivot rod and the threaded member 50. For example, the pivot rod and the through opening can have a square cross section.

Figure 20:
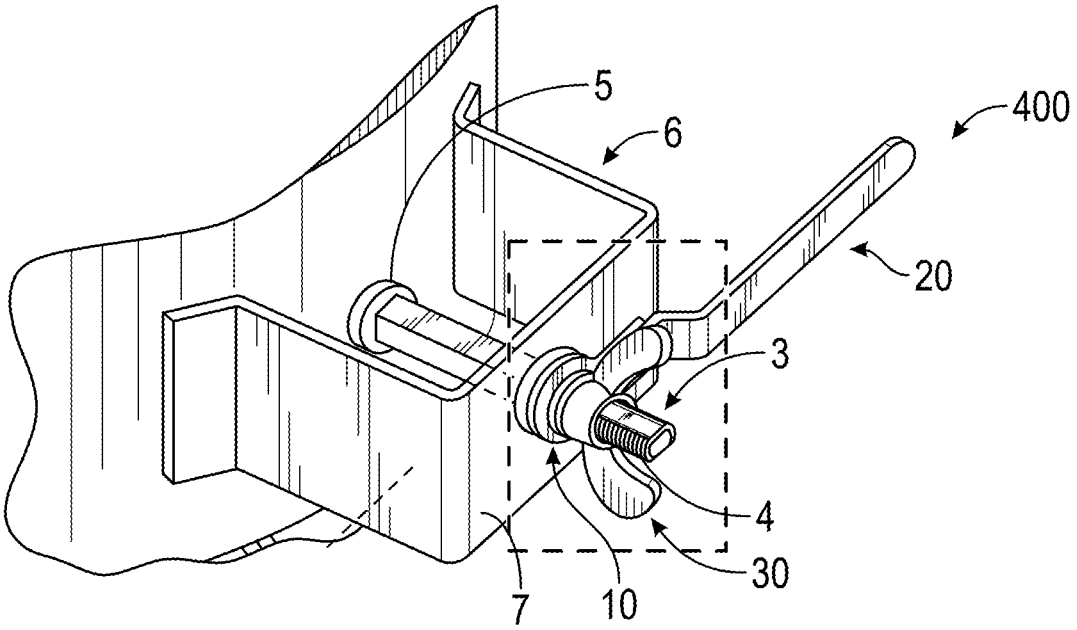
FIG. 20 is a front side perspective view of another embodiment of a damper assembly in accordance with the invention.
Figure 21:
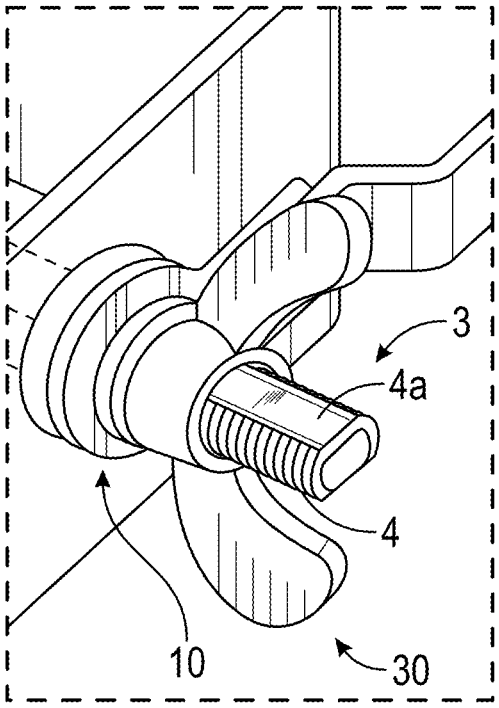
FIG. 21 is an enlarged view of the encircled portion of FIG. 20.
Figure 22:
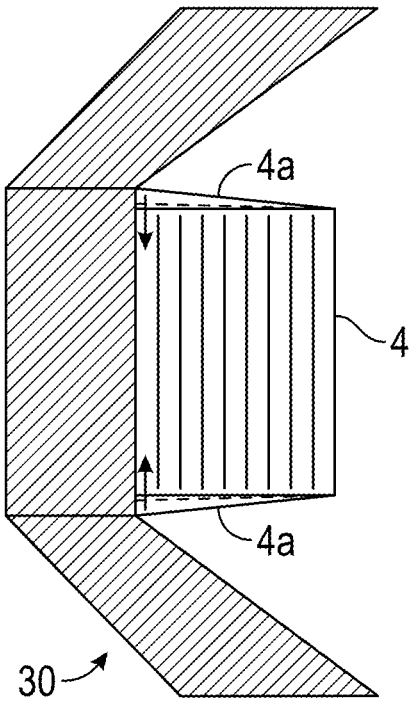
FIG. 22 is a cross sectional view of the pivot rod and threaded member shown in FIG. 21.

In an embodiment of the damper assembly, the end of the pivot rod can have means for preventing disengagement of the threaded member from the pivot rod after engagement of the threaded member on the end 4 of the pivot rod 3. FIG. 20 shows a front side perspective view of an embodiment of ductwork damper assembly 400 in which the pivot rod 3 has a square cross section and its end 4 is provided with tongues 4*a*. FIG. 21 shows an enlarged view of the section of FIG. 20 indicated by the dashed line box. FIG. 22 a schematic cross-sectional view of the threaded member 30 and the pivot rod 4 of FIG. 21. The tongues 4*a* are attached with one of their ends to the terminus of the end 4 of the pivot rod 3 and extend at an angle relative to the pivot rod so that their free end is positioned spaced apart from the pivot rod 3. The tongues 4*a* are resiliently movable relative to the pivot rod so that when the threaded member 30 is pushed onto the end 4 of the pivot rod 3, their free ends are moved toward the pivot rod (see dashed lines in FIG. 22) and thus permit passage of the threaded member 30 over the tongues 4*a*. When the threaded member 30 has passed the tongues 4*a*, the free ends of the tongues 4*a* move radially outwardly again and prevent disengagement of the threaded member 30 from the pivot rod 3.

When the pivot rod has a c-shaped cross section, only a single tongue may be provided on the convex side of the pivot rod. Advantageously, the end of the c-shaped pivot rod 3 has in this case a flat portion on its convex side similar to the flat portion of the end 4 of the square pivot rod 3 shown in FIG. 21. The tongue 4*a* can then be provided on the flat portion in a manner similar to the embodiment shown in FIGS. 21 and 22.

Figure 23:
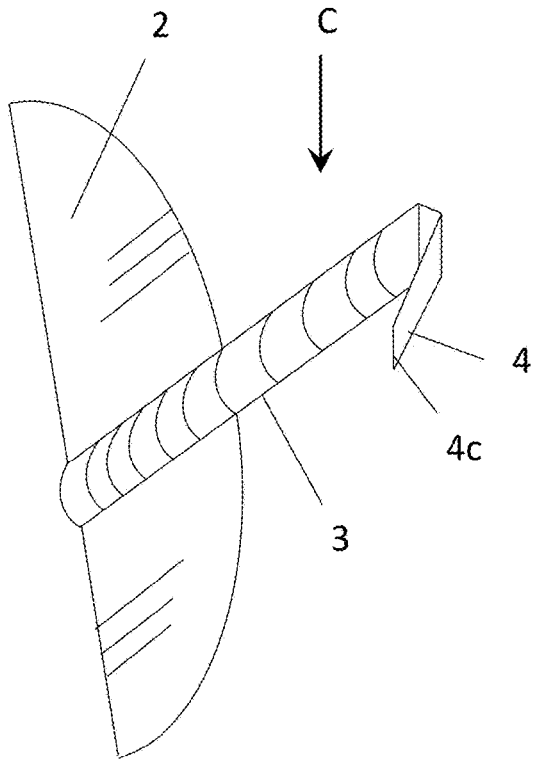
FIG. 23 is schematic illustration of a stamped damper plate with c-shaped pivot rod having a bent end.
Figure 24:
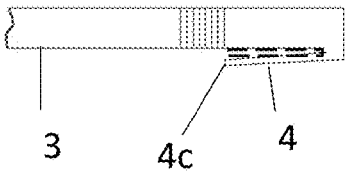
FIG. 24 is a view of the pivot rod of FIG. 23 taken in the direction of arrow C.
Figure 25:
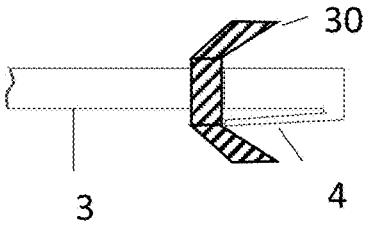
FIG. 25 is the pivot rod of FIG. 24 with the threaded member engaged on the pivot rod.

In another embodiment, the end 4 of the pivot rod 3 can be shaped to provide a structure that prevents disengagement of the threaded member 30 form the pivot rod 3. In an embodiment, the end of the stamped damper plate 2 of the embodiment of the damper assembly 200 can be shaped during the stamping process so that the free end of the pivot rod 3 points toward the damper plate 2 as shown in FIG. 23 and is resiliently movable toward the central longitudinal axis of the pivot rod as illustrated in FIG. 24 by the dashed lines. This permits passage of the threaded member 30 over the free end 4*c*. When the threaded member 30 has passed the free end 4*c*, the free end moves radially outwardly again and prevents disengagement of the threaded member 30 from the pivot rod 3.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A ductwork damper assembly, comprising:

a section of ductwork;

a damper plate attached to a proximal end of a pivot rod, said damper plate pivotably mounted in the section of ductwork via the pivot rod and a distal end of the pivot rod extending radially from the section of ductwork;

a standoff comprising a plate member and a first leg member and a second leg member extending orthogonally from respective opposing sides of the plate member, said plate member having a substantially central aperture, said first leg member and said second leg member of the standoff being in contact with an outer surface of the section of ductwork such that the plate member is spaced apart from the section of ductwork by the first and second leg members, said distal end of the pivot rod extending through the substantially central aperture of the plate member;

a handle mounted on the distal end of the pivot rod in rotative fixed relation with the pivot rod; and a threaded fastener threadedly engaged on threads provided on the distal end of the pivot rod so as to apply an axial force to the plate member and bias the standoff against the outer surface of the section of ductwork, the standoff being biased and held against the section of ductwork absent fixed attachment by any weld, fastener and/or other fastening means at a site of contact between the first leg member and the second leg member of the standoff and the outer surface of the section of ductwork; and wherein the distal end of the pivot rod includes one or more tongues positioned at a terminus of the distal end of the pivot rod, the one or more tongues being resiliently movable with respect to the distal end of the pivot rod and arranged for preventing disengagement of the threaded fastener from the pivot rod.

2. The ductwork damper assembly of claim 1, wherein the first leg member and the second leg member each include a bent foot arranged to interface with the outer surface of the section of ductwork absent fixed attachment by any other fastener and/or other fastening means at the site of contact therebetween.

3. The ductwork damper assembly of claim 1, wherein an opening through the handle conforms to a cross-sectional shape of the distal end of the pivot rod, such that rotation of the handle controls rotation of the damper plate within the section of ductwork via the pivot rod.

4. The ductwork damper assembly of claim 3, wherein a cross-sectional shape of the distal end of the pivot rod is C-shaped and the handle includes a tongue arranged to engage a concave side of the C-shaped pivot rod.

5. A handle assembly for a ductwork damper assembly which includes a section of ductwork having a rotatable damper plate therein, and a pivot rod having a proximate end attached to the damper plate and an opposing distal end extending radially outward from the section of ductwork, the distal end of the pivot rod including an externally threaded portion, wherein the distal end of the pivot rod defines a first threaded member, said handle assembly comprising:

a standoff which comprises a plate member and a first leg member and a second leg member extending from respective opposing sides of the plate member to define a U-shaped bracket, said plate member having a central aperture, wherein the standoff is configured to be biased and held against the section of ductwork absent fixed attachment by any fastener and/or other fastening means provided at a site of contact between the first leg member and the second leg member of the standoff and an outer surface of the section of ductwork;

a second threaded member which is rotatably received in the central aperture of the plate member of the standoff, said second threaded member having a threaded portion with external threads, an outwardly extending flange at an end of the threaded portion, and a through-opening extending axially through the threaded portion of the second threaded member, the through-opening being configured to receive a portion of the opposing distal end of the pivot rod;

a handle or lever mounted about the threaded portion of the second threaded member, the handle or lever being configured for enabling rotation of the second threaded member and the pivot rod extending through the through-opening of the second threaded member with respect to the standoff, and the damper plate with respect to the section of ductwork;

a third threaded member having internal threading and which is dimensioned and shaped for being threadedly received on the external threads of the threaded portion of the second threaded member to retain the handle or lever on the threaded portion of the second threaded member; and a fourth threaded member which engages with the distal end of the pivot rod so as to provide a biasing force on the plate member of the standoff such that the standoff is retained against the section of ductwork absent fixed attachment by any fastener and/or other fastening means provided at the site of contact between the first leg member and the second leg member of the standoff and the outer surface of the section of ductwork.

6. The handle assembly for the ductwork damper assembly of claim 5, wherein the threaded portion of the second threaded member and the handle or lever include notch and groove portions which are arranged to interface with each other and prevent rotational movement of the handle or lever with respect to the pivot rod.

7. The handle assembly for the ductwork damper assembly of claim 5, wherein the plate member includes a raised portion in which the central aperture of the standoff is formed, the raised portion being further configured to receive the outwardly extending flange of the second threaded member while the threaded portion of the second threaded member extends through the central aperture of the standoff.

8. The handle assembly for a ductwork damper assembly of claim 5, wherein the distal end of the pivot rod is C-shaped and the through-opening extending axially through the threaded portion of the second threaded member is C-shaped and dimensioned to receive the C-shaped distal end of the pivot rod, such that rotation of the handle or lever controls rotation of the damper plate within the section of ductwork via rotation of the pivot rod.

9. The handle assembly for a ductwork damper assembly of claim 5, wherein the distal end of the pivot rod includes one or more tongues positioned at a terminus of the distal end of the pivot rod, the one or more tongues being resiliently movable with respect to the distal end of the pivot rod and arranged for preventing disengagement of the fourth threaded member from the pivot rod.

10. The handle assembly for a ductwork damper assembly of claim 5, wherein the first leg member and the second leg member each include a bent foot arranged to interface with the outer surface of the section of ductwork absent fixed attachment by any other fastener and/or other fastening means at the site of contact therebetween.

11. A method of assembling a ductwork damper assembly including a rotatable pivot rod having (i) a proximal end attached to a damper plate and (ii) a distal end which is externally threaded to define a first threaded member, the method comprising the steps of:

providing a handle assembly, said handle assembly including:

a handle or lever configured for attachment at the distal end of the rotatable pivot rod;

a standoff which comprises a plate member with a first leg member and a second leg member extending from respective opposing sides of the plate member to define a U-shaped bracket, said plate member having a substantially central aperture, a second threaded member having an internal threading for being threadedly received on the threaded distal end of the pivot rod;

mounting the handle assembly to a section of ductwork by positioning the plate member of the standoff such that the distal end of the pivot rod passes through the substantially central aperture of the standoff and an opening formed in the handle or lever;

threading and tightening the second threaded member to the threaded distal end of the pivot rod to retain the handle or lever about the threaded distal end of the pivot rod; and engaging at least one resilient tongue positioned at a terminus of the externally threaded distal end of the pivot rod for preventing disengagement of the second threaded member from the pivot rod after engagement of the second threaded member on the distal end of the pivot rod and to maintain an axial force onto the plate member of the standoff by the second threaded member so that the standoff is biased against and held on the section of ductwork absent fixed attachment by any fastener and/or other fastening means provided at a site of contact between the first leg member and the second leg member of the standoff and an outer surface of the section of ductwork.

12. A ductwork damper assembly comprising:

a section of ductwork which houses a rotatable damper plate;

a pivot rod having a proximal end attached to the damper plate and a distal end which includes an externally threaded portion to define a first threaded member;

a handle assembly including:

a handle or lever configured for attachment at the distal end of the pivot rod;

a standoff which includes a plate member and a first leg member and a second leg member extending orthogonally from respective opposing sides of the plate member, said plate member having a central aperture;

a second threaded member having internal threading and threadedly received about the externally threaded portion of the pivot rod to retain the handle or lever about the threaded portion of the pivot rod;

third threaded member threaded on the externally threaded distal end of the pivot rod to apply an axial force onto the plate member of the standoff so that the standoff is biased against and held on the section of ductwork absent fixed attachment by a fastener and/or other fastening means provided at a site of contact between the first leg member and the second leg member of the standoff and an outer surface of the section of ductwork; and wherein the distal end of the pivot rod includes at least one resilient tongue positioned at a terminus of the distal end of the pivot rod and arranged for preventing disengagement of the third threaded member from the pivot rod after engagement of the third threaded member on the distal end of the pivot rod.

13. The ductwork damper assembly of claim 12, wherein the handle or lever is fixedly attached to the distal end of the pivot rod by a complimentarily keyed arrangement therebetween, such that rotation of the handle or lever controls rotation of the damper plate within the section of ductwork via the pivot rod.

14. The ductwork damper assembly of claim 12, wherein the distal end of the pivot rod is C-shaped and the handle includes a tongue arranged to engage a concave side of the C-shaped pivot rod.

15. The ductwork damper assembly of claim 12, wherein the first leg member and the second leg member each include a bent foot arranged to interface with the outer surface of the section of ductwork absent fixed attachment by any other fastener and/or other fastening means at the site of contact therebetween.

* * * * *